US009863390B2

(12) United States Patent
Hirabayashi

(10) Patent No.: US 9,863,390 B2
(45) Date of Patent: Jan. 9, 2018

(54) ENGINE STARTING APPARATUS

(71) Applicant: Denso Corporation, Kariya, Aichi-pref. (JP)

(72) Inventor: Takashi Hirabayashi, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 116 days.

(21) Appl. No.: 14/674,935

(22) Filed: Mar. 31, 2015

(65) Prior Publication Data

US 2015/0285203 A1 Oct. 8, 2015

(30) Foreign Application Priority Data

Apr. 2, 2014 (JP) ..... 2014-076428

(51) Int. Cl.

| | |
|---|---|
| ***F02N 11/08*** | (2006.01) |
| ***F02N 15/02*** | (2006.01) |
| *F02N 11/10* | (2006.01) |
| *F02N 15/06* | (2006.01) |

(52) U.S. Cl.

CPC ..... *F02N 11/0848* (2013.01); *F02N 15/02* (2013.01); *F02N 11/087* (2013.01); *F02N 11/0859* (2013.01); *F02N 11/105* (2013.01); *F02N 11/106* (2013.01); *F02N 15/067* (2013.01); *F02N 2200/043* (2013.01); *F02N 2200/044* (2013.01); *F02N 2200/063* (2013.01)

(58) Field of Classification Search

CPC ..... F02N 11/0848; F02N 2200/043; F02N 2200/044; F02N 2200/063; F02N 11/10; F02N 11/105; F02N 11/106

USPC ..... 701/113

See application file for complete search history.

(56) References Cited

U.S. PATENT DOCUMENTS

| | | | | |
|---|---|---|---|---|
| 4,198,945 | A * | 4/1980 | Eyermann | F02N 11/0848 123/179.3 |
| 5,970,936 | A * | 10/1999 | Cabrera | F02N 11/0848 123/179.3 |
| 6,305,338 | B1 | 10/2001 | Kramer et al. | |
| 6,363,899 | B1 | 4/2002 | Koelle et al. | |
| 6,727,708 | B1 * | 4/2004 | Dougherty | G01R 31/36 320/132 |
| 7,061,130 | B1 * | 6/2006 | Blackburn | F02N 11/04 180/65.22 |

(Continued)

FOREIGN PATENT DOCUMENTS

| | | |
|---|---|---|
| JP | 2000-179394 A | 6/2000 |
| JP | 2002-188549 A | 7/2002 |

(Continued)

*Primary Examiner* — Sizo Vilakazi
*Assistant Examiner* — Kevin R Steckbauer
(74) *Attorney, Agent, or Firm* — Oliff PLC

(57) ABSTRACT

An engine starting apparatus is equipped with a starter which, when it is required to start an engine, moves a pinion to establish engagement with a ring gear coupled to the engine and energizes an electric motor to produce and transmit torque to the ring gear through the pinion for cranking the engine. When the rate of decrease in current flowing in the electric motor or the rate of rise in voltage appearing at a terminal of the starter or a power supply for the electric motor exceeds a given value after the engine starts being cranked, the engine starting apparatus works as a firing-up determiner to determine that the engine has been fully fired up.

8 Claims, 4 Drawing Sheets

(56) References Cited

U.S. PATENT DOCUMENTS 7,061,246 B2 * 6/2006 Dougherty ..... G01R 31/36 324/426
7,145,259 B2 * 12/2006 Spellman ..... F02N 11/0851 123/179.3
8,079,340 B2 * 12/2011 Okumoto ..... F02N 11/0855 123/179.25
8,392,097 B2 * 3/2013 Ma ..... F02D 41/062 123/179.18
8,408,177 B2 * 4/2013 Nagoshi ..... F02N 11/0825 123/179.4
8,843,299 B2 * 9/2014 Kawazu ..... F02N 11/0848 123/179.3
9,200,608 B2 * 12/2015 Neet ..... F02N 11/08
9,410,492 B2 * 8/2016 Miyaki ..... F02M 69/32
9,429,131 B2 * 8/2016 Bradfield ..... F02N 11/0855
2004/0189257 A1 * 9/2004 Dougherty ..... G01R 31/36 320/132
2009/0132151 A1 * 5/2009 Yanagisawa ..... F02D 41/062 701/105
2009/0241883 A1 * 10/2009 Nagoshi ..... F02N 11/0825 123/179.4
2010/0083926 A1 * 4/2010 Okumoto ..... F02N 11/0855 123/179.4
2011/0202263 A1 * 8/2011 Kawazu ..... F02N 11/0848 701/113
2012/0010802 A1 * 1/2012 Ma ..... F02D 41/062 701/113
2013/0042833 A1 * 2/2013 Hartmann ..... F02N 11/087 123/179.25
2013/0104829 A1 * 5/2013 Miyaki ..... F02M 69/32 123/179.3
2013/0133605 A1 * 5/2013 Neet ..... F02N 11/08 123/179.3
2015/0167617 A1 * 6/2015 Fujita ..... F02N 11/0859 701/113
2015/0211465 A1 * 7/2015 Bradfield ..... F02N 11/0855 123/179.3
2015/0316017 A1 * 11/2015 Okada ..... F02N 11/0851 290/38 C
2015/0354523 A1 * 12/2015 Hirabayashi ..... F02N 11/087 123/179.3
2015/0354524 A1 * 12/2015 Hirabayashi ..... F02N 11/0859 123/179.22

FOREIGN PATENT DOCUMENTS

JP 4108920 B2 6/2008
JP 2009-162196 A 7/2009
JP 2010-185460 A 8/2010

* cited by examiner

ENGINE STARTING APPARATUS

CROSS REFERENCE TO RELATED DOCUMENT

The present application claims the benefit of priority of Japanese Patent Application No. 2014-76428 filed on Apr. 2, 2014, the disclosure of which is incorporated herein by reference.

BACKGROUND

1 Technical Field

This disclosure relates generally to an engine starting apparatus equipped with an engine firing-up detector which works to detect the fact that an engine has been fired up.

2 Background Art

There is known a technique of using a value of the speed of an engine or electric current in an electric motor installed in an engine starter as a reference value for determining whether the engine has been started by the engine starter and fired up or not. Specifically, such a system is, as illustrated in FIG. 4, designed to determine that the engine has been fired up (a) when the speed of the engine reaches a given value (e.g., 600 rpm) and (b) when the value of electric current in the engine starter has dropped to a value (i.e., about a no-load current) smaller than a variable range of current consumed by the engine starter in cranking the engine. For example, Japanese Patent Application No. 4108920 teaches the above type of system.

Pinion kick starters designed to kick out a pinion gear into mesh with a ring gear to start the engine usually generate tooth hammering noise between the pinion and the ring gear which arises from a variation in torque during cranking of the engine. In the case of use of such pinion kick starters in automotive vehicles equipped with an idle-stop system (also called an automatic engine stop and restart system), the tooth hammering noise will occur when the engine is restarted, which gives vehicle operators an uncomfortable feeling. In order to alleviate this problem, it is necessary to de-energize the starter as soon as possible after the engine is fired up to move the pinion out of engagement with the ring gear.

Shortening the time needed to restart the engine requires increasing the speed at which the starter cranks the engine to as high as possible.

Use of high speed starters to reduce the time required to restart the engine, however, encounters a difficulty in accurately determining the firing up of the engine by means of the above conditions (a) and (b). The high speed starters, as referred to herein, are starters which are capable of making the circumferential speed of the pinion continue to follow that of the ring gear of the engine at least until start of the third compression stoke of the engine after the engine completes the second compression stroke or in which the speed of cracking the engine will exceed 600 rmp. "The circumferential speed of the pinion continues to follow that of the ring gear" means that torque, as produced by an electric motor of the starter, continues to be exerted by the pinion on the ring gear during cranking of the engine, for example, at least until the start of the third compression stroke of the engine.

The use of the above high speed starters may cause the cranking speed to reach an engine speed which may be used as a reference value at which typical engines are determined as having been fired up. It is, therefore, difficult to determine whether the fact that the reference value is reached results from the firing up of the engine or is caused by the aid of rotation from the starter not the firing up of the engine.

The no-load speed of typical starters usually increases up to a maximum of 350 rpm to 450 rpm, while the no-load speed of the high speed starters increases up to as high as an idle speed of the engine, thus causing the current flowing in the starter motor after the engine is fired up to have a varying waveform similar to that appearing during the cranking of the engine without converging on a constant level. It is, therefore, impossible to determine the firing-up of the engine accurately based on the above condition (b) using the value of current in the starter motor.

SUMMARY

It is therefore an object to provide an engine starting apparatus designed to ensure the accuracy in determining whether an engine has been fired up or not in a case where a high-speed starter is used to start the engine.

According to one aspect of the disclosure, there is provided an engine starting apparatus which comprises: (a) a starter which, when it is required to start an engine, moves a pinion to establish engagement with a ring gear coupled to the engine and energizes an electric motor to produce and transmit torque to the ring gear through the pinion for cranking the engine, after the pinion engages the ring gear, the starter working to rotate the pinion so as to continue to exert the torque on the ring gear; and (b) a firing-up determiner which works to determine that the engine has been fired up when at least one of a first firing-up condition, a second firing-up condition, and a third firing-up condition is met after the pinion engages the ring gear. The first firing-up condition is a condition in which a rate of decrease in current flowing in the electric motor exceeds a given value. The second firing-up condition is a condition in which a rate of increase in voltage appearing at a terminal of the starter exceeds a given value. The third firing-up condition is a condition in which a rate of increase in voltage appearing at a terminal of a power source for the electric motor exceeds a given value.

In conventional starters whose no-load rotational speed increases only up to a maximum of 350 rpm to 450 rpm, the speed of the starter may rise greatly upon disappearance of load thereon, thereby resulting in a sharp drop in current flowing in an electric motor installed in the starter during cranking of the engine.

The starter of the engine starting apparatus is, as described above, designed to rotate the pinion so as to continue to exert the torque on the ring gear of the engine while the engine is being cranked. At the moment when fuel is ignited and burned within a combustion chamber of the engine apply acceleration to the piston of the engine, the degree of acceleration of the ring gear will exceed that of the pinion, so that the torque, as produced by the starter, is not exerted on the ring gear of the engine. The value of current in the motor, thus, subsequently varies in a form which is different from that when the torque, as produced by the starter, continues to act on the ring gear of the engine during the cranking, and exhibits the same rapid change in current as caused by the disappearance of the load on the conventional starters, as described above. The determination of whether the engine has been fired up or not may, therefore, be achieved by monitoring the fact that the current in the motor has dropped sharply.

The voltage appearing at the terminal of the starter or at the terminal of the power source such as a storage battery usually changes with a change in current flowing in the motor. These parameter, thus, may be used in determination of whether the engine has been fired up or not.

The use of at least one of the first to third firing-up conditions improves the accuracy in analyzing the firing-up of the engine.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

Figure 1:
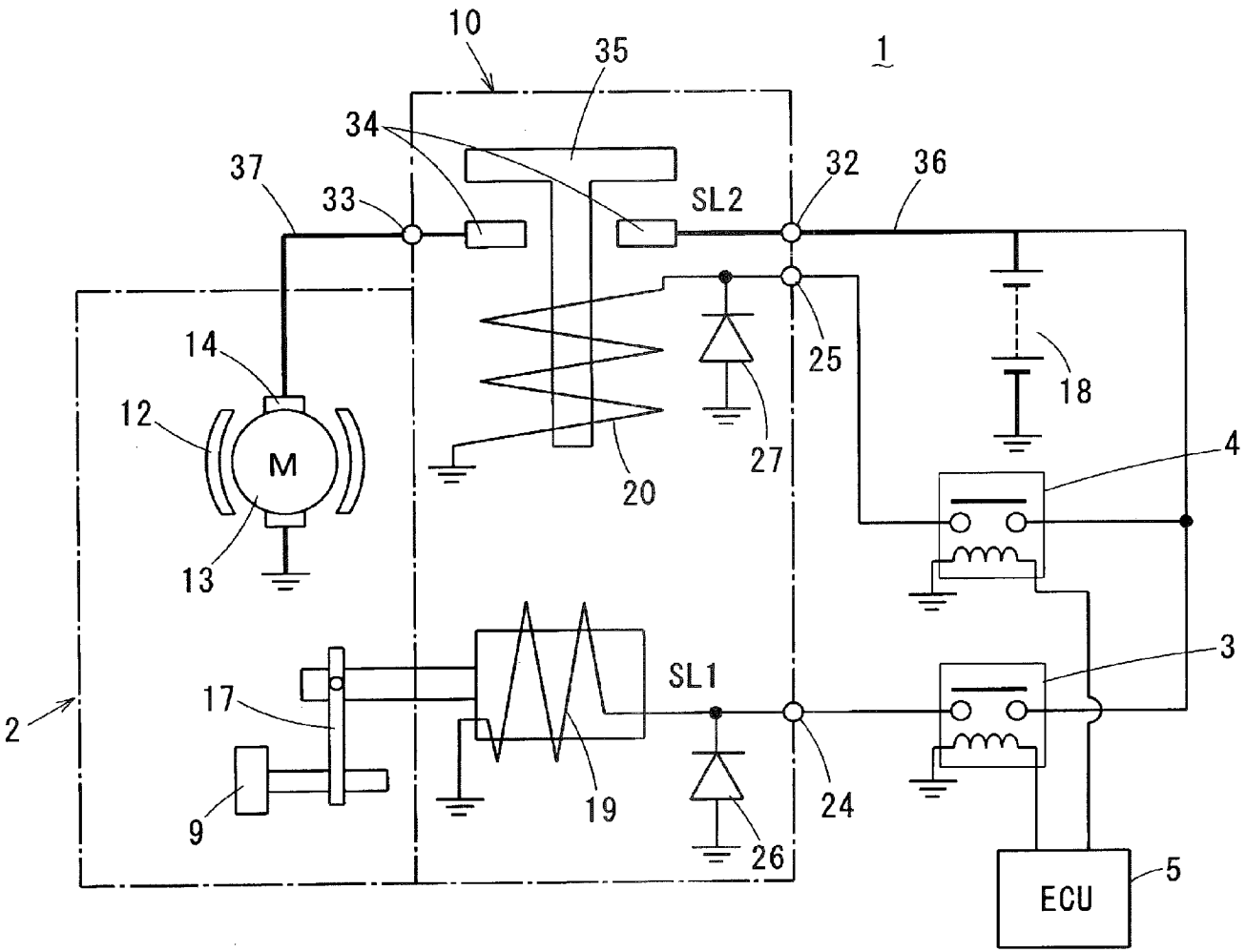
FIG. 1 is a circuit diagram which illustrates a structure of an engine starting apparatus according to the first embodiment.
Figure 2:
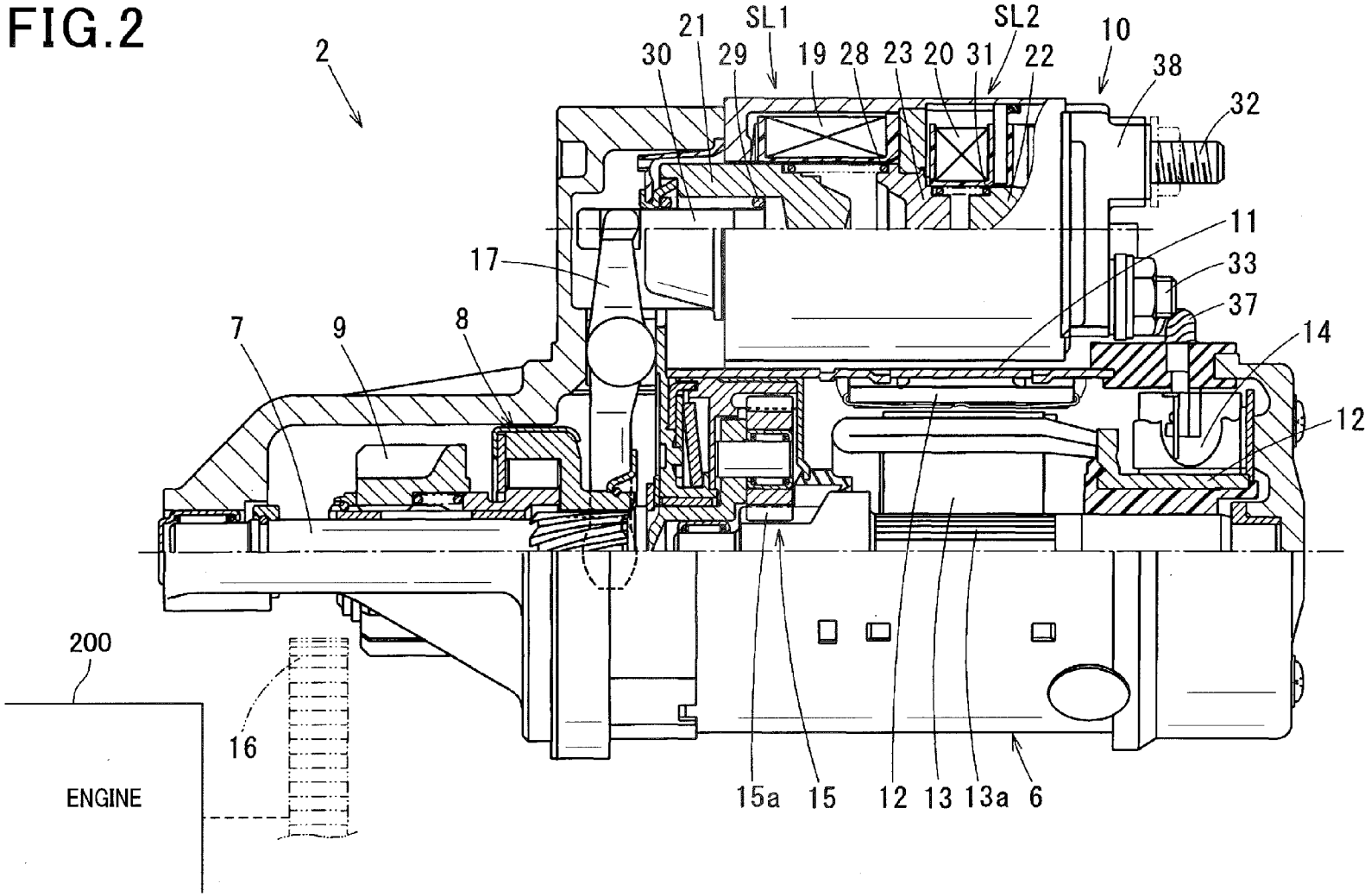
FIG. 2 is a partially longitudinal sectional view which illustrates a starter installed in the engine starting apparatus of FIG. 1.

Referring to the drawings, wherein like reference numbers refer to like parts in several views, particularly to FIG. 1, there is shown an engine starting apparatus 1 according to the first embodiment which may be used with an automatic engine restart system designed to automatically restart the engine 200, as illustrated in FIG. 2. The automatic engine restart system, as referred to herein, is engineered to restart the engine 200 after the engine 200 is automatically, manually, or unintentionally stopped and includes an idle stop system (also called an automatic engine stop and restart system) for automotive vehicles.

The engine starting apparatus 1 includes a starter 2 and a controller 5 which controls an operation of the starter 2 through starter relays 3 and 4. The controller 5 is implemented by an electronic control unit (ECU) and will be referred to as an ECU 5 below.

The starter 2, as illustrated in FIG. 2, includes an electric motor 6 producing torque, an output shaft 7 driven by the motor 6, a pinion 9 fit on the output shaft 7 in connection with a clutch 8, and an electromagnetic solenoid device 10.

The motor 6 is a commutator motor equipped with a field system, an armature 13, and brushes 14. The field system is made up of a plurality of permanent magnets 12 arranged inside an inner circumference of a yoke 11 which forms a magnetic circuit. The armature 13 has a commutator 12 disposed on an axis thereof. The brushes 14 ride on the outer periphery of the commutator 12 to be slidable following rotation of the armature 13.

The output shaft 7 is connected to an armature shaft 13*a* of the armature 13 through a speed reducer 15 and disposed coaxially with the armature shaft 13*a*. The torque of the armature shaft 13*a* (i.e., motor torque) is amplified by the speed reducer 15 and then transmitted to the output shaft 7.

The speed reducer 15 is implemented by, for example, a typical planetary gear train in which planet gears 15*a* rotate around axes thereof and also orbit around an axis of the planetary gear train. The orbital motion of the planet gears 15*a* is transmitted to the output shaft 7.

The clutch 8 fit on the outer periphery of the output shaft 7 through helical splines. The clutch 8 works as a one-way clutch to transmit the torque of the output shaft 7 to the pinion 9, but block the transmission of torque from the pinion 9 to the output shaft 7.

The pinion 9 is pushed away from the motor 6 along the output shaft 7 together with the clutch 8 and then engages the ring gear 16 coupled to the engine 200 to transmit the motor torque, as amplified by the speed reducer 15, to the ring gear 16 when it is required to start the engine 200, that is, when the starter 2 is turned on. The engine 200 is, for example, an internal combustion four-stroke engine.

The electromagnetic solenoid device 10 is equipped with a pinion drive solenoid SL1 and a motor power supply solenoid SL2. The solenoid SL1 works to move the clutch 8 and the pinion 9 together. The solenoid SL2 works to open or close main contacts (which will be described later in detail) which are disposed in a power supply path through which the electric power is supplied from a battery 18 to the motor 6.

The solenoid SL1 includes a coil 19 wound around a resinous bobbin, a plunger 21 which is movable inside an inner circumference of the coil 19 in an axial direction thereof, and a stationary core 23. Similarly, the solenoid SL includes a coil 20 wound around a resinous bobbin, a plunger 22 which is movable inside an inner circumference of the coil 20 in an axial direction thereof, and the stationary core 23. The stationary core 23 is disposed between the plungers 21 and 22 in alignment therewith in the axial direction of the stationary core 23.

The coil 19 is, as clearly illustrated in FIG. 1, connected at an end thereof to a power supply terminal 24 and at the other end thereof to ground. Similarly, the coil 20 is connected at an end thereof to a power supply terminal 25 and at the other end thereof to ground.

The power supply terminals 24 and 25 are joined to the battery 18 through an exciting circuit equipped with the starter relays 3 and 4. Diodes 26 and 27 are connected to the power supply terminals 24 and 25 in parallel to the coils 19 and 20, respectively, in order to short the back electromotive force which is usually produced in the coils 19 and 20 when the starter relays 3 and 4 are turned off.

When the coil 19 is energized so that the stationary coil 23 is magnetized, the plunger 21 of the solenoid SL1 is attracted to the stationary coil 23 against the pressure, as produced by the return spring 28, as illustrated in FIG. 2. To the plunger 21, a plunger rod 30 is attached together with a drive spring 29. The plunger rod 30 and the clutch 8 are connected by a shift lever 17. Similarly, when the coil 20 is energized so that the stationary coil 23 is magnetized, the plunger 22 of the solenoid SL2 is attracted to the stationary coil 23 against the pressure, as produced by the return spring 31, as illustrated in FIG. 2. The stationary coil 23 is, as described above, arranged between the plunger 21 and the plunger 22 and serves as a portion of the magnetic circuit shared by the solenoids SL1 and SL2.

The main contacts, as illustrated in FIG. 1, include a pair of fixed contacts 34 and a movable contact 35. The fixed contacts 34 are connected to the power supply path of the motor 6 through two terminal bolts 32 and 33. The movable contact 35 is responsive to movement of the plunger 22 to electrically open or close the fixed contacts 34.

The terminal bolts 32 and 33 are usually referred to as a B-terminal bolt and an M-terminal bolt, respectively. The B-terminal bolt 32 is electrically connected to the battery 18 through a battery cable 36. The M-terminal bolt 33 is electrically connected to the positive brush 14 through a motor lead 37. The B-terminal bolt 32 and the M-terminal bolt 33 are, as can be seen in FIG. 2, mounted in a resinous cover 38 of the electromagnetic solenoid device 10.

The starter 2 is of a high-speed type capable of rotating at a speed higher than conventional engine starters. Specifically, the starter 2 is engineered to rotate the pinion 9 so as to continue to exert the torque, as produced and transmitted from the motor 6, on the ring gear 16 at least until after fuel in the engine 200 is burned for the first time after the engine 200 is started by the starter 2 or may alternatively be designed to continue to exert the torque on the ring gear 16 at least until after the engine 200 has been fired up, so that the engine 200 continues to run by itself. For example, the starter 2 is designed to bring the circumferential speed of the pinion 9 up to that of the ring gear 16 and keep the rotation of the pinion 9 following that of the ring gear 16 at least until the engine 200 (i.e., a piston) has completed the second compression stroke and then starts the third compression stroke after the engine 200 starts being cranked at normal or room temperature. This condition is generally met in the case where the starter 2 is capable of rotating at 600 rpm or more when cranking the engine 200.

The operation of the starter 2 will be described below.

When it is required to start the engine 200, the ECU 5 first turns on the starter relay 3 and then returns on the starter relay 4. Specifically, the solenoid SL1 first start operating. Subsequently, the solenoid SL2 starts operating.

When the starter relay 3 is turned on to supply the electric power from the battery 18 to the power supply terminal 24, the coil 19 of the solenoid SL1 is energized. This causes the stationary core 23 to be magnetized to attract the plunger 21 in the rightward direction, as viewed in FIG. 2. The rightward movement of the plunger 21 causes the pinion 9 to be thrust by the shift lever 17 together with the clutch 8 away from the motor 6. When the pinion 9 and the ring gear 16 are out of phase in tooth engagement therebetween, it will cause the end surface of the teeth of the pinion 9 to impact that of the ring gear 16, so that the pinion 9 stops advancing.

When the starter relay 4 is turned on to supply the electric power from the battery 18 to the power supply terminal 25, the coil 20 of the solenoid SL2 is energized. This causes the stationary core 23 to be magnetized to attract the plunger 22 in the leftward direction, as viewed in FIG. 2. The leftward movement of the plunger 22 brings the movable contact 34 into abutment with the fixed contacts 34 to achieve an electric connection between the fixed contacts 34, thereby supply the electric power from the battery 18 to the motor 6, so that the armature 13 produces the torque. When the torque is transmitted from the armature 13 to the pinion 9, and then the pinion 9 is placed in phase in tooth engagement with the ring gear 16, each of the teeth of the pinion 9 is pushed into between two of the teeth of the ring gear 16 to establish the meshing between the pinion 9 and the ring gear 16, thereby transmitting the torque, as produced by the motor 6, from the pinion 9 to the ring gear 16 to crank the engine 200.

The operation and beneficial advantages of the first embodiment will be described below.

After the starter 2 starts operating to crank the engine 200, the ECU 5 works as a firing-up determiner to determine whether the engine 200 has been fully started up, in other words, the engine 200 has been fired up or not which means that the engine 200 will continue to run by itself. Specifically, when the current value in the motor 6 drops at a given rate or more, that is, a rate of decrease in current flowing through the motor 6 exceeds an experimentally derived value or a design value (e.g., 5.5 A/msec.) after the pinion 9 meshes with the ring gear 16, in other words, the value of current flowing through the motor 6 drops rapidly, the ECU 5 determines that a firing-up condition (which will also be referred to as a first firing-up condition below) has been met, meaning that the engine 200 has been fully started up. Subsequently, the ECU 5 deactivates the starter 2 (i.e., the electric motor 6) and disengages the pinion 9 from the ring gear 16.

The no-load speed of typical engine starters usually increases only up to 350 to 450 rpm. The speed of the engine starters will, thus, increase sharply upon the disappearance of load thereon during the cranking of the engine 200, so that the current in the motor drops instantaneously rapidly.

Figure 3:
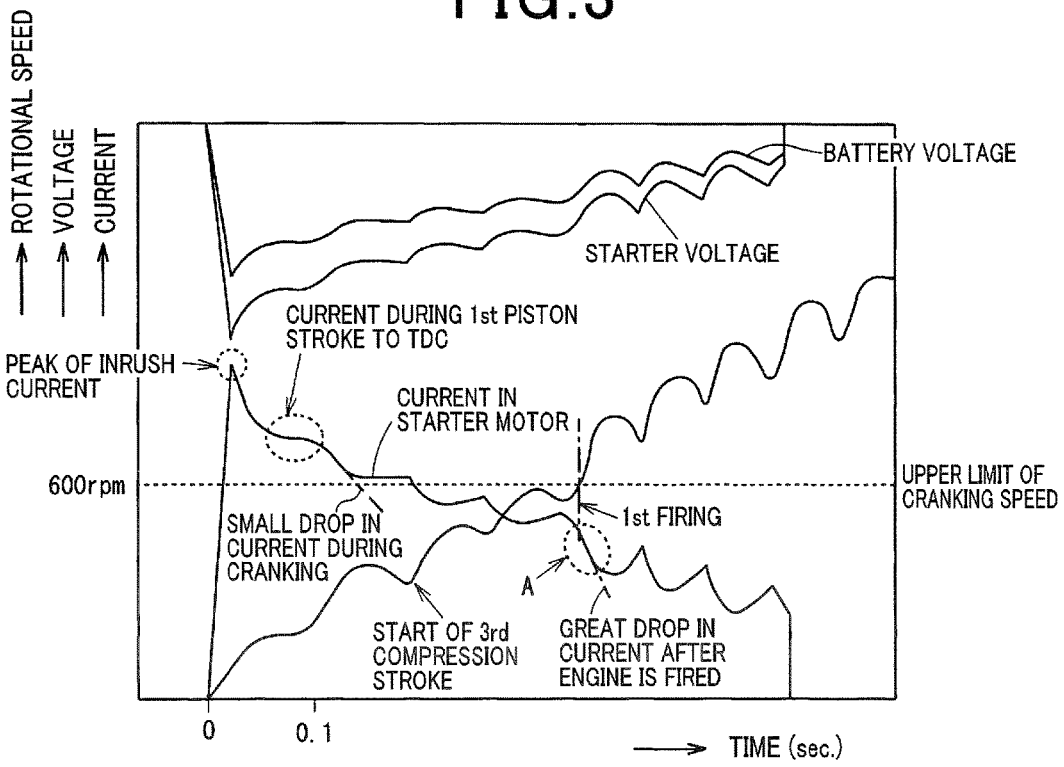
FIG. 3 is a graph which demonstrates changes in engine speed, current in a starter motor, and voltage at a starter or a battery when an engine is started by the engine starting apparatus of FIG. 1.
Figure 4:
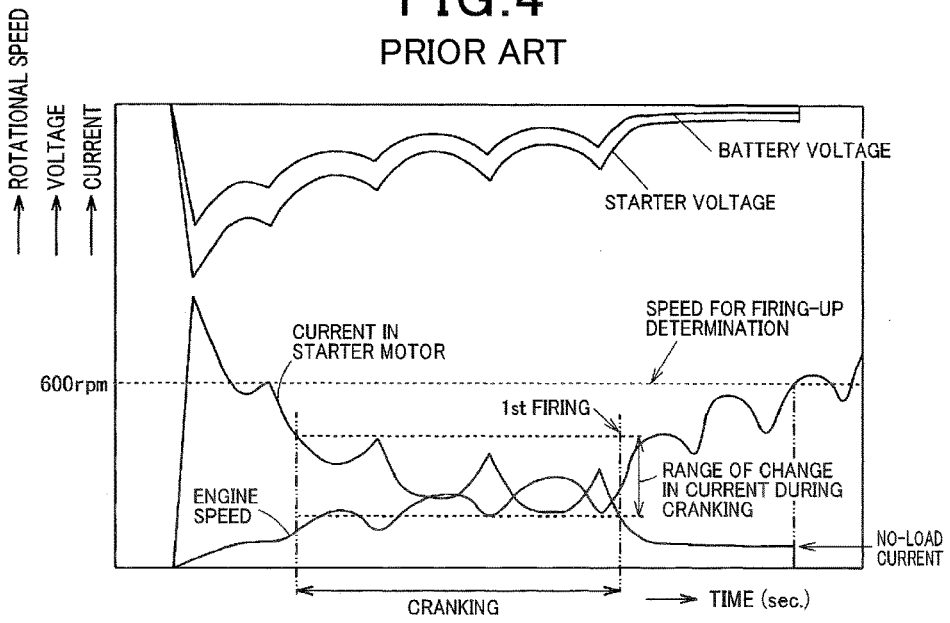
FIG.4 PRIOR ART
FIG. 4 is a graph which exemplifies changes in engine speed, current in a starter motor, and voltage at a conventional starter or a battery when an engine is started by the conventional starter.

In contract, the starter 2 of the first embodiment is capable of making the speed thereof (i.e., the pinion 9) follow that of the engine 200 (i.e., the ring gear 16) even at the moment when the piston of the engine 200 has passed the top dead center, so that the load exerted by the engine 200 on the starter 2 disappears, thus causing the torque, as produced by the starter 2, to continue to act on the engine 200 during the cranking of the engine 200. At the moment when the fuel is ignited within the combustion chamber of the engine 200, so that the piston is accelerated, the degree of acceleration of the ring gear 16 will exceed that of the pinion 9, so that the torque, as produced by the starter 2, is not exerted on the engine 200. The value of current in the motor 6, thus, subsequently varies, as can be seen in FIG. 3, in the form which is different from that when the torque, as produced by the starter 2, continues to act on the engine 200 during the cranking, and includes the same rapid change in current as caused by the disappearance of the load on the typical starters, as described above. The determination of whether the engine 200 has been fired up or not may, therefore, be achieved by monitoring the fact that the current in the motor 6 has dropped sharply.

A portion of a change in current flowing through the motor 6, as enclosed by a circle A in FIG. 3, represents a rapid drop in current in the motor 6, that is, the fact that the engine 200 has been fully fired up. The ECU 5 of this embodiment is, therefore, designed to calculate a rate (i.e., an inclination) of decrease in current flowing in the motor 6 to determine whether such a rate is greater than a given value or not and decide that the engine 200 has been fired up when the rate is determined to be greater than the given value.

Second Embodiment

The engine starting apparatus 1 of the second embodiment is engineered as a firing-up determiner to determine that the engine 200 has been fired up when a firing-up condition (which will also be referred to as a second firing-up condition below) in which a rate (i.e., an inclination) of increase in voltage appearing at the terminal (i.e., the terminal bolt 32) of the starter 2 exceeds a given value is met. The terminal voltage at the starter 2 usually changes as a function of a change in current flowing in the motor 6. The determination of whether the engine 200 has been fired up or not may, therefore, be made by monitoring a sharp change in terminal voltage at the starter 2. Other arrangement are identical with those in the first embodiment, and explanation thereof in detail will be omitted here.

Third Embodiment

The engine starting apparatus 1 of the third embodiment is engineered as a firing-up determiner to determine that the engine 200 has been fired up when a firing-up condition (which will also be referred to as a third firing-up condition below) in which a rate (i.e., an inclination) of increase in voltage appearing at the terminal of the battery 18 exceeds a given value is met. The terminal voltage at the battery 18 usually changes as a function of a change in current flowing in the motor 6. The determination of whether the engine 200 has been fired up or not may, therefore, be made by monitoring a sharp change in terminal voltage at the battery 18. Other arrangement are identical with those in the first embodiment, and explanation thereof in detail will be omitted here.

The firing-up determiner (i.e., the ECU 5) may be designed to determine that the engine 200 has been fired up when at least one of the first, second, and third firing-up conditions is met.

Fourth Embodiment

The engine starting apparatus 1 of the fourth embodiment is engineered as a firing-up determiner to determine that the engine 200 has been fired up when any one of the first, second, and third firing-up conditions used to determine whether the engine 200 has been started up, that is, fired up or not in the first to third embodiments is met successively a given number of times. This eliminates an error in determining whether the engine 200 has been fired up or not, for example, when the engine 200 was first fired instantaneously, but a misfire has occurred upon the second ignition of fuel in the engine 200. This improves the accuracy in determining whether the engine 200 has been fired up or not. Other arrangement are identical with those in the first embodiment, and explanation thereof in detail will be omitted here.

Fifth Embodiment

The engine starting apparatus 1 of the fifth embodiment is engineered as a firing-up determiner to determine that the engine 200 has been fired up when the value of current in the motor 6 is lower than or equal to that flowing in the motor 6 when the piston of the engine 200 advances toward TDC (Top Dead Center) and then passes TDC for the first time after the starter 2 is activated and when any one of the first, second, and third firing-up conditions used in the first to third embodiments is met.

Usually, after the starter 2 is energized, the motor 6 is placed in a no-load condition, that is, accelerates without being subjected to any load until the starter 2 is first subjected to the load arising from the stroke of the piston of the engine 200 toward TDC (which will also be referred to as the first TDC stroke load below). This causes, as clearly illustrated in FIG. 3, the current in the motor 6 or voltage developed at the starter 2 to change sharply between the appearance of the peak of the inrush current in the motor 6 and the occurrence of the first TDC stroke load. When the rate of that change in current in or voltage at the starter 2 exceeds a given value, the ECU 5 determines in error that the engine 200 has been fired up.

In order to alleviate the above problem, the ECU 5 is engineered to start analyzing the firing-up of the engine 200 when the current in the motor 6 has fallen in a range lower than or equal to that flowing in the motor 6 during the first stroke of the piston of the engine 200 to TDC. In other words, the ECU 5 is prohibited from determining whether the engine 200 has been fired up or not when the current in the motor 6 is above that flowing in the motor 6 during the first stroke of the piston of the engine 200 to TDC. This eliminates the error in analyzing the firing-up of the engine 200 which arises from a sharp change in current in or voltage at the starter 2 immediately after the inrush current reaches the peak in the motor 6 and thus improves the accuracy of the firing-up determination. Other arrangement are identical with those in the first embodiment, and explanation thereof in detail will be omitted here.

Sixth Embodiment

The engine starting apparatus 1 of the sixth embodiment is engineered to have a firing-up determiner to determine that the engine 200 has been fired up when any one of the first, second, and third firing-up conditions used in the first to third embodiments is met after a lapse of 0.1 seconds since energization of one of the solenoid SL1 and the solenoid SL2 which is late started to operate. In the case where the engine starting apparatus 1 is, like in the first embodiment, designed to turn on the solenoid SL2 after turning on of the solenoid SL1, the ECU 5 starts determining whether the engine 200 has been fired up or not 0.1 seconds or more after the second solenoid SL2 is activated. In the following discussion, one of the solenoids SL1 and SL2 which is first activated will also be referred to as a first solenoid, while the other of the solenoids SL1 and SL2 which is subsequently activated will also be referred to as a second solenoid below.

Usually, in most typical engine starters, it may be determined that the engagement of the pinion of the starter with the ring gear of the engine has been completed, and the first TDC stroke load has been created 0.1 seconds or later after a starter motor starts being energized electrically. The analysis of the firing-up of the engine 200 made 0.1 seconds or later after the second solenoid SL2 starts being energized electrically, therefore, ensures the accuracy in determining whether the engine 200 has been fired up or not without errors resulting from a sharp change in current in or voltage at the motor 6 usually created immediately after appearance of the peak of the inrush current in the motor 6.

Seventh Embodiment

The engine starting apparatus 1 of the seventh embodiment is engineered to have a firing-up determiner to determine that the engine 200 has been fired up when the speed of the engine 200 is greater than or equal to an upper limit of speed at which the starter 2 cranks the engine 200 and when any one of the first, second, and third firing-up conditions used in the first to third embodiments is met. The upper limit of speed, as referred to herein, is a maximum possible speed at which the starter 2 is able to crank the engine 200 the fastest and which depends upon the ability of the starter 2, the type of the engine 200 and other factors. The upper limit of speed may be derived experimentally or as a design value.

When fuel is burned within the combustion chamber of the engine 200, so that the piston is accelerated, it will cause the speed of the engine 200 when being fired up to be higher than that of the engine 200 when being cranked by the starter 2. When the speed of the engine 200 lies within a range higher than or equal to the upper limit of speed of the engine 200 being cranked, it is, thus, possible to accurately determine whether the engine 200 has been fired up or not without errors, as described in FIG. 3, which result from a sharp change in current in or voltage at the motor 6 usually created immediately after appearance of the peak of the inrush current in the motor 6.

Eighth Embodiment

The engine starting apparatus 1 of the eighth embodiment is engineered to have a firing-up determiner to determine whether the engine 200 has been fired up or not using a plurality of threshold values for any one of the first, second, and third firing-up conditions used in the first to third embodiments. For instance, in the first embodiment, the firing-up determiner (i.e., the ECU 5), as described already, works to compare the rate of decrease in current flowing through the motor 6 with the given value (i.e., a single threshold value) to determine whether the engine 200 has been fired up or not. When the eighth embodiment is used with the first embodiment, the firing-up determiner is designed to have two or more threshold values and selects one of them as a function of the ambient temperature of the starter 2 and/or discharge characteristic of the battery 18. For example, the ECU 5 stores therein a map which lists a relation of the plurality of threshold values to the ambient temperature of the starter 2, a discharge characteristic of the battery 18, the temperature of oil in the engine 200, and/or the temperature of coolant for the engine 200 and selects one of the threshold values based on the ambient temperature of the starter 2, the discharge characteristic of the battery 18, the temperature of oil in the engine 200, and/or the temperature of coolant for the engine 200 for use in comparing with the rate of decrease in current flowing through the motor 6. This compensates for an error in the firing-up determination arising from a change in ambient temperature or the discharge characteristic of the battery 18.

The eighth embodiment may also be used with one of the fourth to seventh embodiments. For instance, the ECU 5 may have a plurality of threshold values and selects one of them as a function of the ambient temperature of the starter 2, the discharge characteristic of the battery 18, and/or another parameter for comparison with the speed of the engine 200 in the seventh embodiment.

Modification

The starter 2 of the first embodiment is, as described above, equipped with the electromagnetic solenoid device 10 which serves to move the pinion 9 and open or close the main contacts through the discrete solenoids SL1 and SL2, respectively, however, may alternatively be designed to have only a single typical electromagnetic switch equipped with a solenoid actuator to perform the above two functions. In the case where the starter 2 equipped with such a type of electromagnetic switch is used in the sixth embodiment, the firing-up determiner determines that the engine 200 has been fired up when one of the first to third firing-up conditions is met at least 0.1 seconds after the start of energization of the electromagnetic switch.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An engine starting apparatus comprising:

a starter which, when it is required to start an engine, moves a pinion to establish engagement with a ring gear coupled to the engine and energizes an electric motor to produce and transmit torque to the ring gear through the pinion for cranking the engine, after the pinion engages the ring gear, the starter working to rotate the pinion so as to continue to exert the torque on the ring gear at least until after fuel in the engine is burned for the first time after the engine is started by the starter; and an electronic control unit, the electronic control unit configured to control the starter to bring an instantaneous circumferential speed of the pinion at a point of contact between the pinion and the ring gear up to an instantaneous circumferential speed of the ring gear at the point of contact between the pinion and the ring gear at least from a time at which the pinion starts exerting torque on the ring gear until the engine has completed a second compression stroke and starts the third compression stroke after the engine started being cranked at normal or room temperature, and the electronic control unit further configured to operate as a firing-up determiner which works to determine that the engine has been fired up when at least one of a first firing-up condition, a second firing-up condition, and a third firing-up condition is met after the pinion engages the ring gear, the first firing-up condition being a condition in which a rate of decrease in current flowing in the electric motor exceeds a given value, the second firing-up condition being a condition in which a rate of increase in voltage appearing at a terminal of the starter exceeds a given value, the third firing-up condition being a condition in which a rate of increase in voltage appearing at a terminal of a power source for the electric motor exceeds a given value.

2. An engine starting apparatus as set forth in claim 1, wherein when one of the first, second, and third firing-up conditions is met successively a plurality of times, the firing-up determiner determines that the engine has been fired up.

3. An engine starting apparatus as set forth in claim 1, wherein when a value of current flowing in the electric motor is lower than or equal to that flowing in the electric motor when a piston of the engine advances toward a Top Dead Center and then passes the Top Dead Center for the first time after the starter is activated and when one of the first, second, and third firing-up conditions is met, the firing-up determiner determines that the engine has been fired up.

4. An engine starting apparatus as set forth in claim 1, wherein the starter is equipped with a pinion drive solenoid working to drive the pinion toward the ring gear and a motor power supply solenoid working to supply electric power to the electric motor or block supply of the electric power to the electric motor, wherein a first solenoid that is one of the pinion drive solenoid and the motor power supply solenoid is activated earlier than a second solenoid that is the other of the pinion drive solenoid and the motor power supply solenoid, and wherein the firing-up determiner determines that the engine has been fired up when one of the first, second, and third conditions is met 0.1 seconds or more after the second solenoid is activated.

5. An engine starting apparatus as set forth in claim 1, wherein the starter is equipped with a single electromagnetic switch which works to drive the pinion toward the ring gear and also supply electric power to the electric motor or block supply of the electric power to the electric motor, and wherein the firing-up determiner determines that the engine has been fired up when one of the first, second, and third conditions is met 0.1 seconds or more after the electromagnetic switch is activated.

6. An engine starting apparatus as set forth in claim 1, wherein when a speed of the engine is higher than or equal to a maximum possible speed at which the starter cranks the engine and when one of the first, second, and third conditions is met, the firing-up determiner determines that the engine has been fired up.

7. An engine starting apparatus as set forth in claim 1, wherein the firing-up determiner has a map which lists a relation of a plurality of threshold values to an ambient temperature of the starter, a discharge characteristic of the power source, a temperature of oil in the engine, or a temperature of coolant for the engine, the firing-up determiner selects one of the threshold values as a function of the ambient temperature of the starter, the discharge characteristic of the power source, the temperature of oil in the engine, or the temperature of coolant for the engine and uses the selected one as the given value for use in a corresponding one of the first, second, and third firing-up conditions.

8. A combination of an automatic engine restart system designed to automatically restart an engine and an engine starting apparatus comprising:

a starter which, when it is required to start or restart an engine, moves a pinion to establish engagement with a ring gear coupled to the engine and energizes an electric motor to produce and transmit torque to the ring gear through the pinion for cranking the engine, after the pinion engages the ring gear, the starter working to rotate the pinion so as to continue to exert the torque on the ring gear at least until after fuel in the engine is burned for the first time after the engine is started by the starter; and an electronic control unit, the electronic control unit configured to control the starter to bring an instantaneous circumferential speed of the pinion at a point of contact between the pinion and the ring gear up to an instantaneous circumferential speed of the ring gear at the point of contact between the pinion and the ring gear at least from a time at which the pinion starts exerting torque on the ring gear until the engine has completed a second compression stroke and starts the third compression stroke after the engine started being cranked at normal or room temperature, and the electronic control unit further configured to operate as a firing-up determiner which works to determine that the engine has been fired up when at least one of a first firing-up condition, a second firing-up condition, and a third firing-up condition is met after the pinion engages the ring gear, the first firing-up condition being a condition in which a rate of decrease in current flowing in the electric motor exceeds a given value, the second firing-up condition being a condition in which a rate of increase in voltage appearing at a terminal of the starter exceeds a given value, the third firing-up condition being a condition in which a rate of increase in voltage appearing at a terminal of a power source for the electric motor exceeds a given value.

* * * * *